US006570097B2

(12) United States Patent
Monde et al.

(10) Patent No.: US 6,570,097 B2
(45) Date of Patent: May 27, 2003

(54) CONNECTOR

(75) Inventors: Hiroyuki Monde, Tokushima (JP); Akira Tabuchi, Tokushima (JP); Shogo Kawakami, Osaka (JP)

(73) Assignee: Otsuka Chemical Co., Ltd., Osaka (JP)

( * ) Notice: Subject to any disclaimer, the term of this patent is extended or adjusted under 35 U.S.C. 154(b) by 0 days.

(21) Appl. No.: 09/937,613

(22) PCT Filed: Jan. 26, 2001

(86) PCT No.: PCT/JP01/00516

§ 371 (c)(1),
(2), (4) Date: Sep. 27, 2001

(87) PCT Pub. No.: WO01/56116

PCT Pub. Date: Aug. 2, 2001

(65) Prior Publication Data

US 2002/0182935 A1 Dec. 5, 2002

(30) Foreign Application Priority Data

Jan. 28, 2000 (JP) ..... 2000/020343

(51) Int. Cl.[7] ..... H01B 17/00

(52) U.S. Cl. ..... 174/137 B; 174/138 R; 174/149 R; 174/176

(58) Field of Search ..... 174/137 B, 138 R, 174/149 R, 176; 324/538

(56) References Cited

U.S. PATENT DOCUMENTS 3,634,814 A * 1/1972 Inacker ..... 439/631
3,702,422 A * 11/1972 Schor ..... 333/182
3,975,072 A * 8/1976 Ammon ..... 439/70
5,183,972 A * 2/1993 Duane et al. ..... 174/251
5,844,523 A * 12/1998 Brennan et al. ..... 174/138 A
6,113,730 A * 9/2000 Ohya et al. ..... 156/288

OTHER PUBLICATIONS

Japanese Patent Laid–Open No. 243936 (1994) & English Abstract Thereof.
Japanese Patent Laid–Open No. 96814 (1994) & English Abstract Thereof.
Japanese Patent Laid–Open No. 162227 (1996) & English Abstract Thereof.
Japanese Patent Laid–Open No. 215819 (1994) & English Abstract Thereof.

* cited by examiner

*Primary Examiner*—Dean A. Reichard
*Assistant Examiner*—Jinhee J Lee
(74) *Attorney, Agent, or Firm*—Townsend & Banta

(57) ABSTRACT

A connector with inhibited crosstalk for high speed signal circuits, where the connector contains an insulator formed from a resin composition obtained by incorporating 5 to 85% by weight of a ceramic dielectric powder having a dielectric constant of 30 or more determined at 25° C. and 1 MHz in a matrix resin, and the insulator is substantially homogeneous in the dielectric constant throughout the insulator.

12 Claims, 2 Drawing Sheets

CONNECTOR

BACKGROUND OF THE INVENTION

1. Field of the Invention

The present invention relates to connectors, and more particularly, to a connector suitable for high-speed signal circuits in which crosstalk is inhibited and impedance matching can easily be established.

2. Related Art

In recent years, as electronic information devices grow more sophisticated, the rate of signals treated with electronic circuits is increasing very rapidly. Moreover, circuits are being densified and integrated, and a distance between signal lines is being shortened. Because of such increase in the rate of signal transmission and miniaturization of devices, to secure packaging technology and wiring technology which can control noises and delay is increasing in importance to such an extent that it becomes a governing condition of the whole system.

In light of such a present situation, there have been made a variety of suggestions for dealing well with high-speed, high-density signal circuits also in the field of connectors. What is important for connectors for high-speed, high-density signal circuits is crosstalk control and impedance matching. Crosstalk is a failure associated with an electromagnetic behavior of signals in a high-frequency circuit and refers to a phenomenon that signal lines arranged side by side interfere with each other. With reduction in a distance between signal lines resulting from densification of a circuit, the crosstalk control is becoming an important challenge. Impedance matching refers to a procedure to cause signal circuits mutually connected to have a predetermined impedance (usually standardized at 50 Ω, 75 Ω or 90 Ω) since if the circuits have impedances mismatched, reflection of signals and the like will occur at connecting portions thereof. To reduce an electrical transmission efficiency or to control the generation of reflected waves by establishing impedance matching is becoming an important challenge for achieving the increase in signal transmission velocity (the increase in frequency). Moreover, impedance mismatching itself will cause crosstalk.

As means for solving such problems, Japanese Patent Laid-Open No. 243936(1994) discloses a composition wherein an earthed conductor is disposed between signal terminals. In such a composition, however, a connector structure becomes complicated and its applicable range will be restricted. Japanese Patent Laid-Open No. 96814(1994) provides means for ensuring impedance matching by adjusting the area of the main body parts of terminals. This approach is unique as an impedance matching method, but is not suitable for a small production because to design the optimum shape requires the adjustment involving the change of a mold. Japanese Patent Laid-Open No. 162227 (1996) proposes to adjust the area facing the adjoining contact to reduce impedance, thereby adjusting it. This approach, however, can not deal with those having impedances lower than the predetermined impedances due to limitations in design.

Japanese Patent Laid-Open No. 215819(1994) discloses means for establishing impedance matching by reducing impedance through providing, to paired conductor portions, such plane parts that can be given predetermined capacitances. However, also this approach requires much labor to form conductor portions of special shapes and the designing of the shapes of the plane parts is difficult.

Other various suggestions have been made in this technical field, but any means sufficiently simple and effective is not known, yet.

SUMMARY OF THE INVENTION

The object of the present invention is to provide a connector which can match impedances easily and a method for matching the impedance of a connector.

The connector of the present invention is that comprising an insulator and two or more conductor portions provided side by side within the insulator. The insulator is characterized by being formed of a composition obtained by incorporating, to a matrix resin, 5 to 85% by weight of a ceramic dielectric powder having a dielectric constant of 30 or more determined at 25° C. and 1 MHz.

In the present invention, the dielectric constant, determined at 25° C. and 1 MHz, of the resin composition constituting the insulator is preferably 5 to 20, and more preferably 7 to 15.

Moreover, in the present invention, it is preferable that the insulator is substantially homogeneous in the dielectric constant throughout the insulator.

The method for impedance matching of the present invention is that in which the impedance of an impedance matching-type connector is matched and is characterized by constituting the insulator of a connector by using a resin composition having a dielectric constant of 5 to 20 determined at 25° C. and 1 MHz.

The resin composition constituting the insulator of the present invention is that obtained by incorporating, to a matrix resin, 5 to 85% by weight of a ceramic dielectric powder having a dielectric constant of 30 or more determined at 25° C. and 1 MHz.

The matrix resin can be selected appropriately from various kinds of thermoplastic resins and thermosetting resins. However, from the viewpoints of moldability, heat resistance and mechanical strength, desirably used are polycarbonate resin, polyethylene terephthalate resin (PET resin), polybutylene terephthalate resin (PBT resin), polyamide resin such as polyamide 46, polyamide 6T, polyamide 6/6T, polyamide 6, polyamide 66, polyamide 11 and polyamide 12, polyphenylenesulfide resin, polyethersulfone resin, poly 1,4-cyclohexane-dimethylene-terephthalate resin (PCT resin), polyamideimide resin, polyphenylene ether resin (including polyphenylene oxide or the like), modified polyphenylene ether resin, polyphenylene ether resin including alloy resin made of polyphenyl ether resin and polyetherimide resin, polystyrene resin (particularly, syndiotactic polystyrene resin is preferred), 5-methylpentene resin, cyclic polyolefin resin, heat resistant ABS resin, aromatic polysulfone resin, polyether imide resin, polyether ketone resin, polyether ether ketone resin, polyether nitrile resin, thermotropic liquid crystal polyester resin (LCP), melt-resistant fluororesin, thermoplastic polyimide resin and the like.

Furthermore, the thermosetting resins are exemplified by triazine resin, thermosetting polyphenylene ether resin, epoxy resin and the like.

These resins can be used alone or after the mixing of two or more of them.

As the ceramic dielectric powder having a dielectric constant of 30 or more determined at 25° C. and 1 MHz (this may, hereinafter, be referred simply to as "a ceramic dielectric powder"), there can be employed powders of various kinds of ceramics known as ferroelectrics typified by divalent metal salts of titanic acid typified by alkaline earth metal titanates such as barium titanate, lead titanate, strontium titanate, calcium titanate, barium-strontium titanate and barium-calcium titanate; metal zirconates such as barium-lead zirconate and lead zirconate; vanadic acid compounds such as sodium vanadate; metal niobates such as sodium niobate, potassium niobate, lead niobate and cadmium niobate; metal tantalates such as lithium tantalate, sodium tantalate, potassium tantalate, rubidium tantalate and lead tantalate; metal oxides such as titanium oxide, molybdenum oxide and tungsten oxide; and complex oxides such as lead titanate zirconate. Such a powder may be those having various shapes such as granular material, fibrous material and squamous material. Among them, fibrous powder and squamous powder are preferable because these can contribute also to the improvement in strength. Those having a dielectric constant of 100 or more determined at 25° C. and 1 MHz are particularly preferable. These may be employed either alone in a single sort or in combination of two or more sorts. Preferred specific examples of them include metal titanates represented by a general formula MO $TiO_2$ (in the formula, M denotes one kind or at least two kinds of metal selected from Ba, Sr, Ca, Mg, Co, Pd, Be and Cd) such as barium titanate, strontium titanate, calcium titanate, magnesium titanate, barium-strontium titanate and barium-calcium titanate. Fibrous powders having an average particle diameter of 0.05 to 3 $\mu$m and an average aspect ratio of 3 to 200 are particularly preferable because of their excellent dielectric characteristics in a high-frequency region and of their reinforcing effects.

Of these metal titanates, most of their powdered products are easy to commercially obtain as commodity chemicals. Some fibrous products are marketed, but they can also be produced by the following production method. That is, an example may be a method comprising mixing a titanium source compound such as a titania compound represented by a general formula, $TiO_2 \cdot mH_2O$ (in the formula, m is $0 \leqq m < 8$) and one or two or more substances which can become oxides of metal M on heat and heating them to react at 600 to 900° C. in the presence of a flux such as alkali metal halide. Moreover, as another method, they can be produced by covering, by a coprecipitation method, a surface of fibrous titania compound with a carbonate of metal M in an amount approximately equal to the molar amount of titanium and then heating.

As the ceramic dielectric powder, composite fiber comprising a metal titanate represented by general formula MO $TiO_2$ (in the formula, M denoting one kind or two or more kinds of metals selected from Ba, Sr, Ca, Mg, Co, Pd, Be and Cd) and amorphous titanium oxide compositely united together in the form where the metal titanate is involved in the amorphous titanium oxide wherein the molar ratio of M to Ti is 1:1.005 to 1.85 can also be preferably used. Specific examples of such composite fiber include composite fiber comprising barium titanate and amorphous titanium oxide compositely united together in the form where the barium titanate is involved in the amorphous titanium oxide, and composite fiber comprising barium-strontium titanate and amorphous titanium oxide compositely united together in a form where the barium-strontium titanate is involved in the amorphous titanium oxide.

As a method for producing these composite fibers, they can be produced by covering the surface of a fibrous titania compound with a carbonate of metal M in a predetermined molar amount less than titanium by a coprecipitation method and thereafter heating. The thus obtained composite fiber is desirable since a connector superior in mechanical strength can be obtained therefrom because the composite fiber is strong as fiber and it is less broken off during its kneading into resin or molding.

Details of the production method of a dielectric powder that can be employed in the present invention are disclosed in Japanese Patent Nos. 2639989, 2716197, 2627955, 2788320, 2814288, 2711583, 276165, etc.

The resin composition constituting the insulator of the present invention is that obtained by incorporating 5 to 85% by weight of a ceramic dielectric powder to a matrix resin. Here, the incorporation ratio may be set so as to coincide the desired impedance in the connector. However, in usual, a dielectric constant of the resin composition is preferably set so that a dielectric constant determined at 25° C. and 1 MHz becomes approximately 5 to 20, and in many cases, approximately 7 to 15. In such ranges, crosstalk can be controlled effectively.

To the resin composition for constituting the insulator of the present invention can be optionally incorporated, in addition to a matrix resin and a ceramic dielectric powder, coupling agents such as silane coupling agents, titanate coupling agents and zircoaluminate coupling agents, fine powder fillers such as talc, which is superior in an effect of improving a plating property, flame retardants such as those of phosphorus type, halogen type, antimony type and phosphazene type, coloring agents such as dyes and pigments, lubricants/sliding agents such as polyolefin powders, fluororesins and fats, mold releasing agents, impact-resistance imparting agents such as elastomer, which has the effect of improving impact resistance, antioxidants superior in improvability in heat stability, etc.

Moreover, unless the effect of the present invention is impaired, reinforcing fillers such as glass fiber, milled glass fiber, potassium titanate fiber, aluminum borate fiber, magnesium borate fiber, wollastonite, xonotlite, boehmite and mica can be used together. Particularly, the use of squamous fillers such as boehmite and mica is effective in reducing warp, which is desirable to be controlled especially in connectors.

The resin composition constituting the insulator can be obtained by, but is not limited to, dry-mixing ingredients as needed, followed by kneading and extruding with a twin screw kneader, followed by pelleterizing with a pelletizer.

It is preferable that the incorporation ratio of the ceramic dielectric powder to the matrix resin is adjusted appropriately so that the resin composition constituting the insulator has a dielectric constant determined at 25° C. and 1 MHz of approximately 5 to 20, in many cases, approximately 7 to 15. Here, the upper limit of the dielectric constant is restricted due to the increase in signal loss and to the deterioration of moldability caused by the incorporation of a great amount of ceramic dielectric powder.

The dielectric constant is to be set appropriately depending on the material, shape and the like of other parts constituting the insulator and the connector. However, the setting of the dielectric constant of the resin composition constituting the insulator to such a high value that can hardly be thought of with the conventional insulators (dielectric constant of approximately 2.0 to 4.5) can establish impedance matching while signal loss is controlled. Furthermore, to cause the insulator to have a capacitance is conducible to the control of crosstalk.

The relationship between the amount ($V_0$) of the ceramic dielectric powder incorporated and the dielectric constant ($\epsilon_0$) of the resin composition can be approximated with the following formula (1) using the dielectric constant ($\epsilon_1$) of the ceramic dielectric powder and the dielectric constant ($\epsilon_2$) of the matrix resin:

$$\log \epsilon_0 = V_0 \cdot \log \epsilon_1 + (1 - V_0) \cdot \log \epsilon_2 \quad (1)$$

Using the above formula (1), the amount ($V_0$) of the ceramic dielectric powder required to be incorporated for the setting of a desired dielectric constant $\epsilon_0$.

Molding can be performed by injection molding, transfer molding, press molding, etc.

The manufacture of the connector of the present invention can be performed by combining an obtained insulator with other parts of a contact, or by integrally molding by insert molding while placing, in advance, a conductive element in the mold during the molding process of the insulator.

The connector of the present invention may be used by being combined with a variety of techniques which have conventionally be proposed. Furthermore, the connector may be combined with a technique of shielding around a insulator with a shielding member as needed.

The optimal design of the connector of the present invention can be established through a test small production performed prior to a mass production, followed by the measurement of the characteristic impedances of the respective resulting test connectors performed with the connectors installed in an instrument to be adopted, followed by appropriate varying of the amount of a dielectric powder based on the results of the measurement.

In other words, the relationship between the dielectric constant ($\epsilon_0$) and the impedance ($Z_0$) can be approximated by the following formula (2) using a constant K which is determined from the shape of the insulator, the shape of the connector and the conditions of the circuit to be connected to the connector, and therefore, adjustment can be done so that the dielectric constant is made lower for increasing the characteristic impedance and that the dielectric constant is made higher for reducing the characteristic impedance.

$$Z_0 = K/\epsilon_0^{1/2} \quad (2)$$

Such a characteristic impedance is under the influence of the shape of a connector, the circuit to be connected, a circuit disposed therearound and the like. In the design of the conventional precision connectors, therefore, a characteristic impedance adjustment requires to form and modify a mold two or more times, resulting in the necessity of a long time for launching products. On the other hand, in the connector of the present invention, impedance matching can be established easily by the adjustment of the composition of the resin composition with the shape of the insulator and the shape of the conductor portion itself unchanged, resulting in the saving of time required for the conventional formation and modification of molds and also permitting a great reduction of a time required until the beginning of the production of products.

Moreover, by varying the mixing compositions, insulators having the same shape formed with the identical mold can be produced for use in circuits corresponding to different impedances.

Furthermore, since the shape of an insulator or a connector can be designed relatively freely according to the present invention, the shape of the connector can be changed freely depending upon the requirement on the scaling down and packaging of instruments.

The connector of the present invention may be either of the type where it is mounted directly to a substrate or of the type where it is connected to a cable. The connector can be used for various applications such as interconnection between a plurality of circuit boards, interconnection between a plurality of devices, interconnection between connectors and circuit boards, interconnection between connectors, and integrated circuit sockets such as CPU sockets.

BEST MODE FOR CARRYING OUT THE INVENTION

Figure 1:
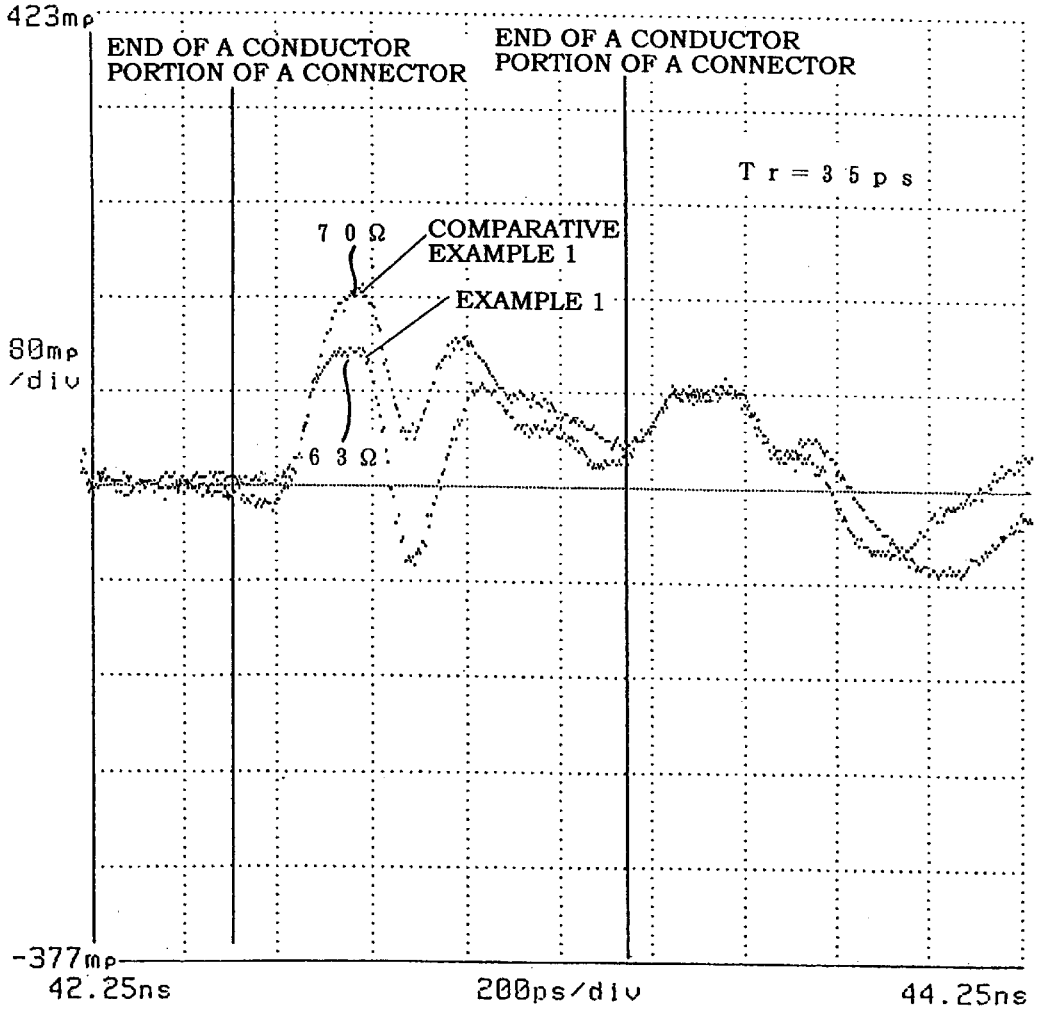
FIG. 1 is a graph illustrating an impedance profile of a connector prepared in Example in accordance with the present invention.

The present invention will be explained in more detail by citing Example and Comparative Example.

PRODUCTION EXAMPLE

Pellets of the resin compositions of Example and Comparative Example in the compositions provided in Table 1 were prepared in the usual method. The dielectric constant of the resulting pellets were determined by the capacity method (1 MHz) or the cavity resonator method (3 GHz). The results are given in Table 1. The amounts incorporated shown in Table 1 are in % by weight.

The materials used are as follows.

LCP: Thermotropic liquid crystal polyester resin; manufactured by Polyplastics Co., Ltd.; the trade name: Vectra E950

$BaTiO_3$: Barium titanate powder; average particle diameter 1.2 $\mu$m; dielectric constant (25° C., 1 MHz) 100 or more; manufactured by Fuji Titanium Industry Co., Ltd.; the trade name: HBT-3

$BaSrTiO_3$: Barium-strontium titanate fiber; average fiber diameter 0.4 $\mu$m; average fiber length 3 $\mu$m; dielectric constant (25° C., 1 MHz) 100 or more; manufactured by Otsuka Chemical Co., Ltd.; the trade name: BSTW $TiO_2$: Titanium oxide powder; average particle diameter 0.5 $\mu$m; dielectric constant (25° C., 1 MHz) 50 or more; manufactured by Ishihara Sangyo Kaisha, Ltd.; the trade name JR-800

Glass fiber: E glass staple fiber; diameter 13 am; fiber length 1.5 mm; dielectric constant (25° C., 1 MHz) 8 or less; manufactured by Nippon Electric Glass Co. Ltd.

TABLE 1

| | (Test Example) | | | | | |
|---|---|---|---|---|---|---|
| | Ex. 1 | Ex. 2 | Ex. 3 | Ex. 4 | Comp. Ex. 1 | Comp. Ex. 2 |
| LCP | 50 | 50 | 50 | 70 | 100 | 70 |
| $BaTio_3$ powder | | 50 | | | | |
| $BaSrTio_3$ fiber | 50 | | | 30 | | |
| $Tio_2$ powder | | | 50 | | | |
| Glass fiber | | | | | | 30 |
| Dielectric Constant (1 MHz) | 8.0 | 7.2 | 8.7 | 5.2 | 3.1 | 4.1 |
| Dielectric Constant (3 GHz) | 8.8 | 7.7 | 9.1 | 5.4 | 3.4 | 4.4 |

Using the resin composition pellets of Example land those of Comparative Example 1 obtained in the above Production Example, a paired connector comprising a male and female connectors was formed by injection molding (insert molding). The resulting male and female connectors were fitted together and the end of the conductor portion of the male connector and that of the female connector were connected to a pulse generator and a digital sampling oscilloscope. The impedance profiles of the connectors fitted respectively were detected. The results are shown in FIG. 1.

The results show that the connector of Example 1 has an impedance peak reduced by 10% in comparison to the connector of Comparative Example 1 (70 Ω→63Ω). In other words, it is shown that the connector of Example 1 is a high-performance connector in which the reflection caused by impedance mismatching or the generation of crosstalk is controlled correspondingly in comparison to the connector of Comparative Example 1.

Figure 2:
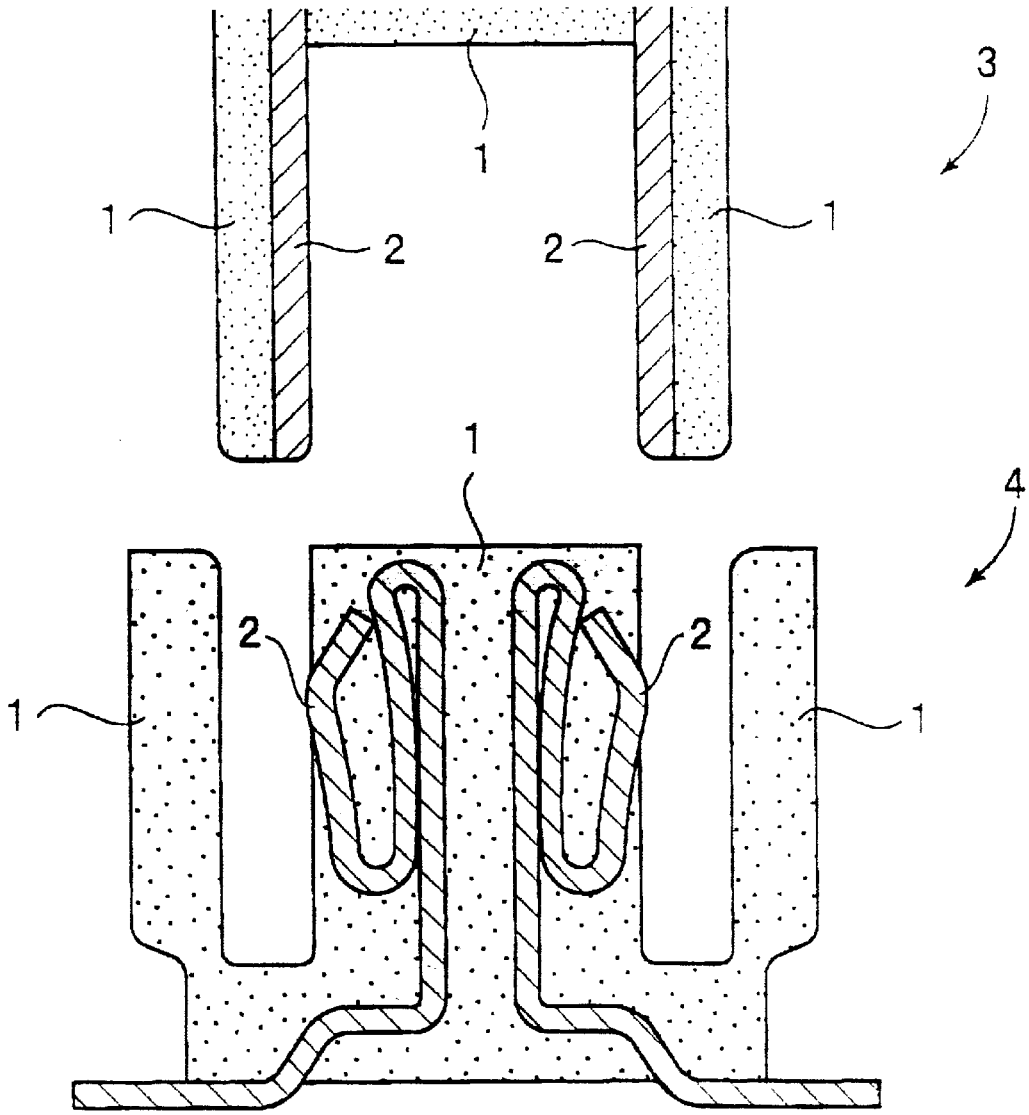
FIG. 2 is a cross-sectional view of an impedance matching paired connector according to the present invention, illustrating in particular male and female connector portions.

An impedance matching connector constructed according to the present invention is illustrated in FIG. 2. The connector in FIG. 2 comprises a female connector 3 which comprises insulator 1 having two conductor portions 2 disposed side by side within insulator 1. A matching male connector 4 comprises insulator 1 having two conductor portions 2 disposed side by side within insulator 1. In operation, the male connector 4 is inserted into a cavity in female connector 3 so as to form a completed electrical circuit. Paired connector as illustrated in FIG. 2 is particularly suitable for high-speed signal circuits in which crosstalk is prohibited.

INDUSTRIAL APPLICABILITY

As described above, according to the present invention, impedances can easily be matched without any changes in the shape of a connector, or the like.

What is claimed is:

1. A connector comprising an insulator with two or more conductor portions disposed side by side within said insulator, said insulator being formed of a resin composition obtained by incorporating 5 to 85% by weight of a ceramic dielectric powder having a dielectric constant of 30 or more determined at 25° C. and 1 MHz in a matrix resin, said connector having matching impedance whereby crosstalk is inhibited in high speed signal circuits.

2. The connector according to claim 1, wherein the ceramic dielectric powder is an alkaline earth metal titanate powder.

3. The connector according to claim 2, wherein the ceramic dielectric powder is a fibrous alkaline earth metal titanate powder.

4. The connector according to claim 1, wherein the resin composition constituting the insulator has a dielectric constant of 7 to 15 determined at 25° C. and 1 MHz.

5. The connector according to claim 4, wherein the insulator is substantially homogeneous in said dielectric constant throughout the insulator.

6. The connector according to claim 4, wherein the ceramic dielectric powder is an alkaline earth metal titanate powder.

7. The connector according to claim 1, wherein the resin composition constituting the insulator has a dielectric constant of 5 to 20 determined at 25° C. and 1 MHz.

8. The connector according to claim 7, wherein the ceramic dielectric powder is an alkaline earth metal titanate powder.

9. The connector according to claim 7, wherein the insulator is substantially homogeneous in said dielectric constant throughout the insulator.

10. The connector according to claim 9, wherein the ceramic dielectric powder is an alkaline earth metal titanate powder.

11. A method for producing a connector for a high speed signal circuit having inhibited crosstalk, comprising forming an insulator in said connector from a resin composition having a dielectric constant of 5 to 20 determined at 25° C. and 1 MHz, whereby said connector has matching impedance.

12. A paired connector for high speed signal circuits comprising male and female connectors, the female connector comprising an insulator having two or more conductor portions disposed side by side within said insulator, said insulator being formed of a resin composition obtained by incorporating 5 to 85% by weight of a ceramic dielectric powder having a dielectric constant of 30 or more determined at 25° C. and 1 MHz to a matrix resin, said paired connector having matching impedance in which crosstalk is inhibited.

* * * * *